US007171700B2

(12) United States Patent
Glew

(10) Patent No.: US 7,171,700 B2
(45) Date of Patent: Feb. 6, 2007

(54) AUTOMATIC TOILET

(75) Inventor: Daniel John Glew, Auckland (NZ)

(73) Assignee: Exeloo Limited, Auckland (NZ)

( * ) Notice: Subject to any disclaimer, the term of this patent is extended or adjusted under 35 U.S.C. 154(b) by 170 days.

(21) Appl. No.: 10/788,476

(22) Filed: Mar. 1, 2004

(65) Prior Publication Data

US 2005/0188451 A1 Sep. 1, 2005

(51) Int. Cl.
*A47K 13/00* (2006.01)

(52) U.S. Cl. ..... 4/233

(58) Field of Classification Search ..... 4/222, 4/233, 237

See application file for complete search history.

(56) References Cited

U.S. PATENT DOCUMENTS 4,785,482 A * 11/1988 Nelva-Pasqual et al. ..... 4/233
4,853,982 A * 8/1989 Martinval ..... 4/233

* cited by examiner

*Primary Examiner*—Huyen Le
(74) *Attorney, Agent, or Firm*—Young & Thompson

(57) ABSTRACT

An automatic toilet seat cleaning unit comprises a cabinet adapted to receive at least one toilet seat in a stowed position, an electric motor operatively connected to the toilet seat and a cleaning unit. The unit is adapted to clean a toilet seat when the seat is raised or moved to be stowed within the cabinet by the electric motor. The cabinet includes at least one door adapted to open to allow a toilet seat to be received in the stowed position. Also included is a method of operating the cleaning unit.

22 Claims, 3 Drawing Sheets

AUTOMATIC TOILET

TECHNICAL FIELD

This invention relates to an automatic toilet seat cleaning unit and method of operating said unit.

BACKGROUND ART

It has been found, particularly with unisex toilet units, that there is a need for regular cleaning of the toilet, the toilet seat and also of the unit itself. There are a number of European manufacturers who have developed different methods for automatic cleaning of toilet seats.

One solution is to provide a plastics sleeve which pulls out around the toilet seat. Another solution is to slide the toilet seat horizontally out onto the bowl from a recess and recycle this toilet seat with a second toilet seat whilst the first (now used) toilet seat is cleaned within the recess.

Another is to have no toilet seat and to tip the entire toilet bowl back into a cleaning area. Yet another is to locate the toilet seat on gearing that allows the toilet seat to be rotated around the bowl and to pass through a cleaning device at the back of the bowl. This device is described in U.S. Pat. No. 4,790,036 Schnyder; Erika entitled Method and Device for the Automatic Cleaning of a Toilet Seat.

U.S. Pat. No. 6,003,158 of YU; YI-CHEH describes a device for automatically cleaning toilet seats, with gearing which allows for the toilet seat to be rotated about 360°.

These solutions are complex and expensive to maintain.

A further and important consideration when developing a solution to the problem of automatically cleaning toilet seats, is one of safety and the prevention of possible injuries, in particular of children. Injury is possible especially if any moving parts are driven such as when a seat and door are taken to a down or extended position to be ready for use. A yet further problem with the prior art toilet seat cleaning apparatus, is the lack of vandal resistance and the need to limit possible public access to parts of the unit. Damage to the parts of any public toilet can be a problem especially if someone attempts to force various parts. Also most current toilet seat washing systems make no allowance for disabled people or the infirm or children, in their construction and use.

OBJECT OF THE INVENTION

It is therefore an object of the present invention to provide an improved automatic toilet seat cleaning unit or method of operating said unit which will obviate or minimise the foregoing disadvantages in a simple yet effective manner or which will at least provide the public with a useful choice.

STATEMENT OF THE INVENTION

Accordingly in one aspect of the present invention there is provided an automatic toilet seat cleaning unit comprising; a cabinet adapted to receive at least one toilet seat in a stowed position or non use position, an electric operating means operatively connected to the seat, a cleaning means to clean the toilet seat when the seat is or has been stowed within the cabinet by the electric operating means, and at least one door adapted to open to allow the toilet seat to be received or be in the stowed position.

Preferably the electric operating means raises the toilet seat such that the toilet seat is washed by the cleaning means.

Preferably the unit includes a control unit to control the cleaning and or seat movement.

Preferably the control unit is a PLC or PC board.

Preferably the cabinet can be rebated into the wall of a public toilet cubicle.

Preferably the public toilet has a service bay where the cabinet is located therein.

Preferably the cleaning means comprises at least one spray means located inside or through the cabinet.

Preferably the cleaning means can be located near the top face of the toilet seat with a second cleaning means for the bottom face of the seat if this is practical.

Preferably the cleaning means is a fluid.

Preferably the electric operating means utilizes extra low voltage to operate.

Preferably the unit comprises a shaft connecting the back of the toilet seat to the sides of the cabinet, a lever pivotally connected to a chain and a first motor pivotally connected to the said lever and operable to move the seat up and down, the electric operating means providing a power supply to said motor, a switch to detect when the seat is in an up position, the first motor having an electrical output to control the moveable seat from a down to an up position, the first motor also having a reverse polarity output to control the moveable seat from an up to a down position and a solenoid valve to control at least one water spray jet.

Preferably the unit includes a spring loaded clutch to allow the toilet seat to be moved manually.

Alternatively the unit comprises a carriage connecting the back of the toilet seat, rails connected to the sides of the cabinet, the carriage slidably connected to the rails, a chain connected to an electric operating means providing a power supply to a first motor and drum connected to said carriage and operable to move the seat up/down, a power supply to said motor, a switch to detect when the seat is in an up position, the first motor having an electrical output to control the moveable seat from a down to an up position, the first motor having a reverse polarity output to control the moveable seat from an up to a down position, a solenoid valve to control at least one water spray jet.

Preferably a second chain is connected to said door, a second motor and drum is connected to said chain and operable to move the door up/down, a switch to detect when the door is in an open position, the second motor having a power supply output to control the door from an up to a down position, the second motor having a reverse polarity power output to control the door from a down to an up position.

Preferably the second motor 101 has the second chain 102 connected to the door wherein in operation, the second chain coils around drum 100 which raises the door into the open position, when the door open switch 96 is reached the first motor 10 drives the drum 11 which is mounted on the outside of cabinet, the first chain 12 which goes around a pulley located at the back bottom corner of the cabinet and is connected to the lever L so when the first motor 10 operates the chain coils around the drum 11 pulling on lever 7 which rotates the shaft which the seat is attached to causing the seat to tilt up into the cabinet, once the seat reaches the up unit switch 16, the second motor 101 is reversed to uncoil the chain from drum 100 causing the door to close.

Preferably the second motor 101 drives the drum 100 which is supported on each side of the cabinet wherein the second chain 102 being attached to the door 90, as the drum revolves the second chain is wound up around the drum 100 lifting up the door, once the door meets a door up switch 96, the first motor 10 is activated, the first motor 10 being connected to another drum 11 which is supported on each side of the cabinet wherein the first chain 12 being attached to the seat carriage 14, as the drum revolves, the first chain is wound up around the drum 11 pulling the seat and carriage up the rails.

Preferably the door is closeable by gravity when the second motor is reversed.

Preferably the unit includes a dryer apparatus which comprises a fan that directs air into the cabinet to dry the seat.

Preferably the dryer apparatus includes a plenum having air exit means shaped to create an air knife effect when being used to dry the seat.

Accordingly in another aspect of the present invention there is provided a method of operating an automatic toilet seat cleaning unit wherein the unit comprises a cabinet adapted to receive at least one toilet seat in an up position or non use position, an electric operating means, a cleaning means to clean a toilet seat when the seat is within said cabinet, an operating activation means and at least one door located on the cabinet, the door being adapted to open to allow the toilet seat to be received into the up position or non use position; the method including:

pressing the activation means;

door opens or is raised;

seat dropping down to a lowered or ready to be used position;

closing or lowering the door enabling actual use of the seat;

after use, raising the door;

moving seat to be within the cabinet;

cleaning means cleans the seat.

Preferably the cleaning includes washing.

Preferably after the toilet seat is washed and while it is still within the cabinet or while the lifting the door, the seat is dried by a dryer apparatus.

Preferably after use of the seat, when activating a sensor or pressing a cubicle door opening button, seat wash unit will be activated to raise the seat wash door and retract the seat into the seat wash cabinet for washing.

To those skilled in the art to which the invention relates, many changes in construction and widely differing embodiments and applications of the invention will suggest themselves without departing from the scope of the invention as defined in the appended claims. The disclosures and the description herein are purely illustrative and are not intended to be in any sense limiting.

BRIEF DESCRIPTION OF THE DRAWINGS

Further aspects and advantages of the present invention will become apparent from the ensuing description of a preferred embodiment, given by way of example only, and with reference to the attached drawings in which.

DETAILED DESCRIPTION

Referring the drawings there is shown the automatic toilet seat cleaning unit having two separate seat movement mechanism options. The systems include lifting a unit door up with a motor attached to the side of a cabinet which drives a stainless steel drum going across the inside the cabinet supported by a nylon bush on each side. This drum has a stainless steel chain attached to it and also attached to the door and, as the drum revolves, it winds the chain around the drum lifting up the door. Once the door is in the open position, a second motor drives a drum which either rotates or tilts an shaft or axle to tilt the seat into the stowed or substantially up position or drags or retracts the seat and a mounting carriage, up a set of rails.

On the tilt seat washer, we follow the concept of tilting the seat into its required position on a central axle but, to make this work with the electric motor, we attach single chain end to the lever and bring it down to a pulley before taking it up to a drum which is driven by the winder motor.

Figure 1:
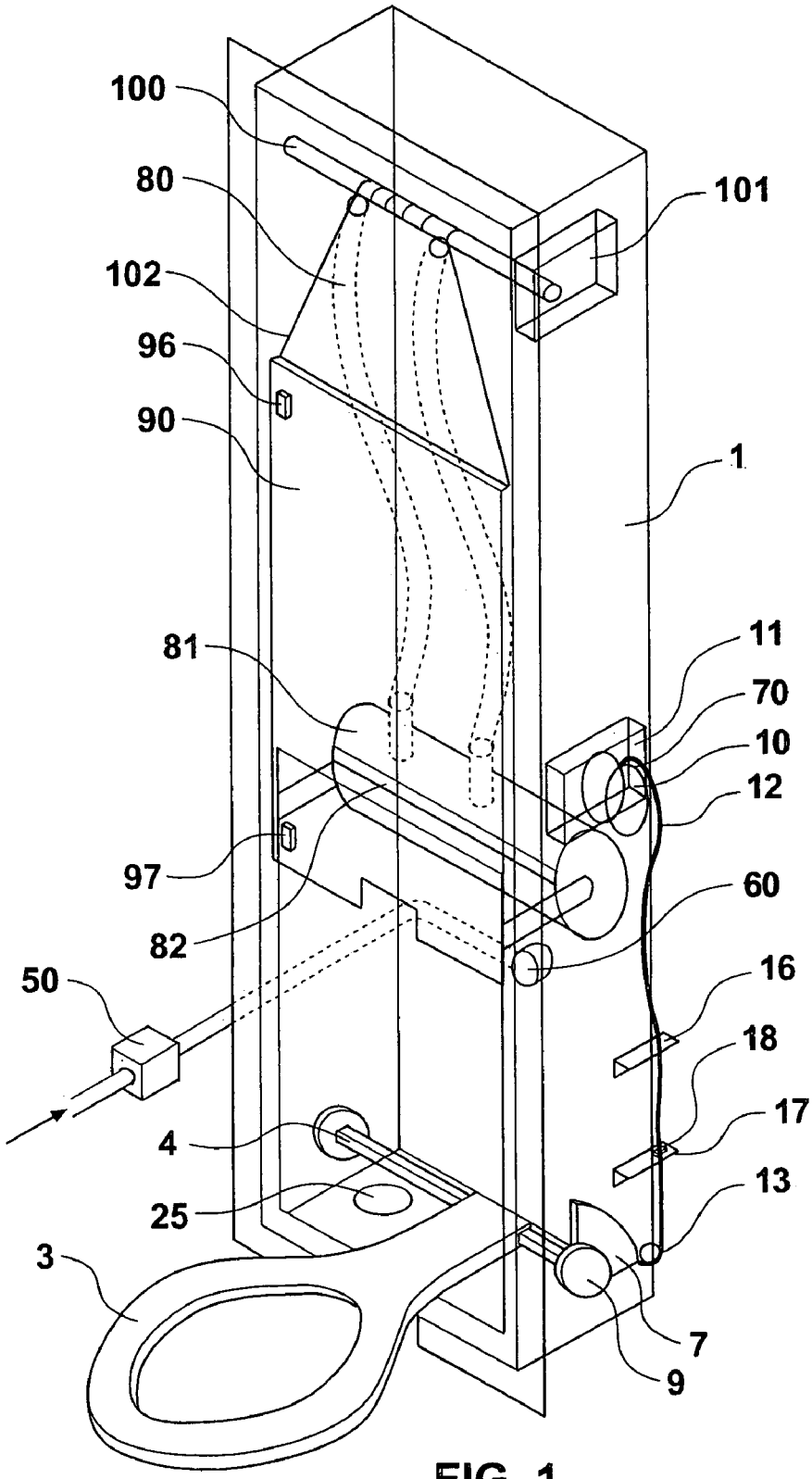
FIG. 1 is a perspective view of one preferred embodiment of the present invention
Figure 2:
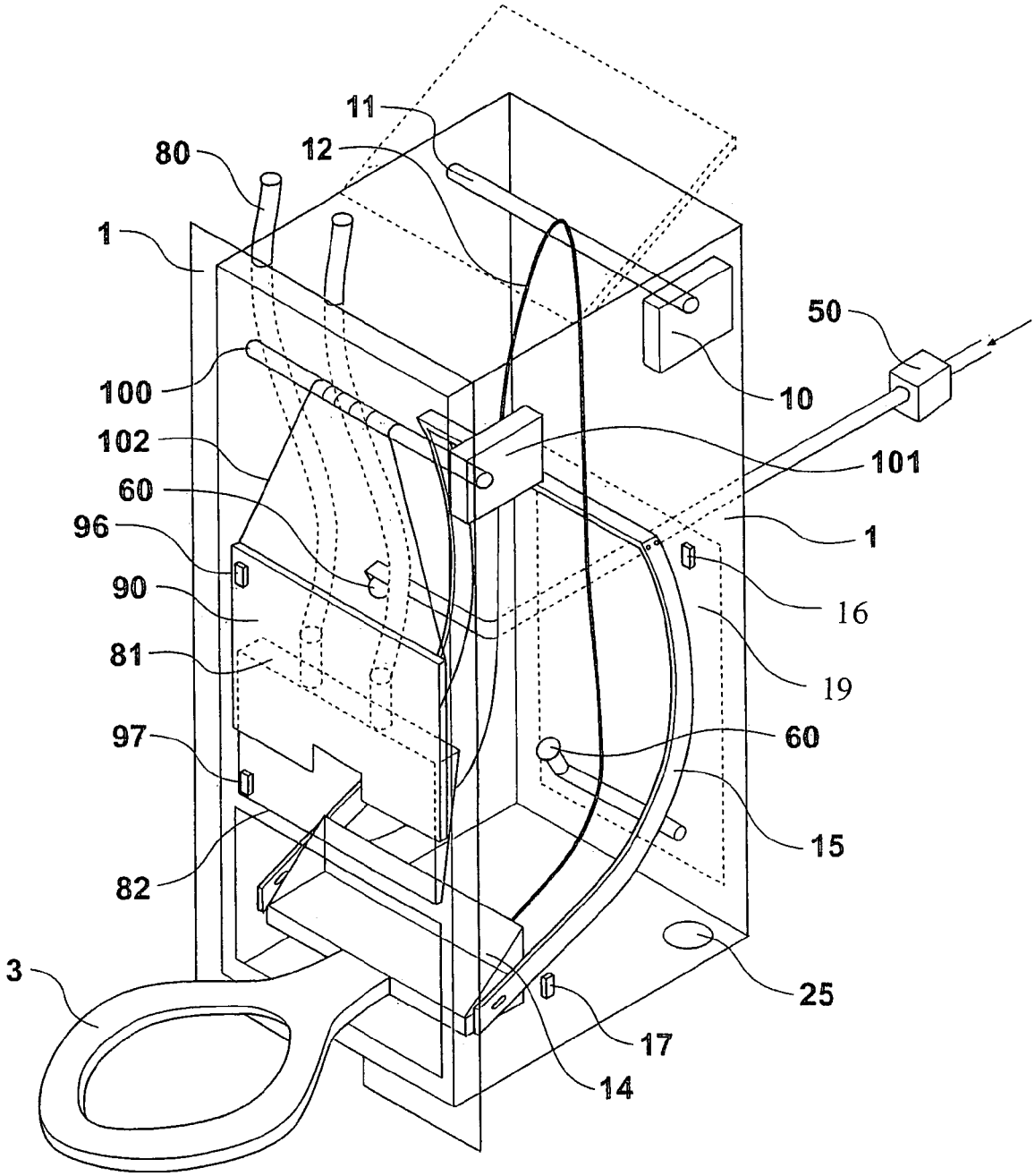
FIG. 2 is a perspective view of another preferred embodiment of the present invention.
Figure 3:
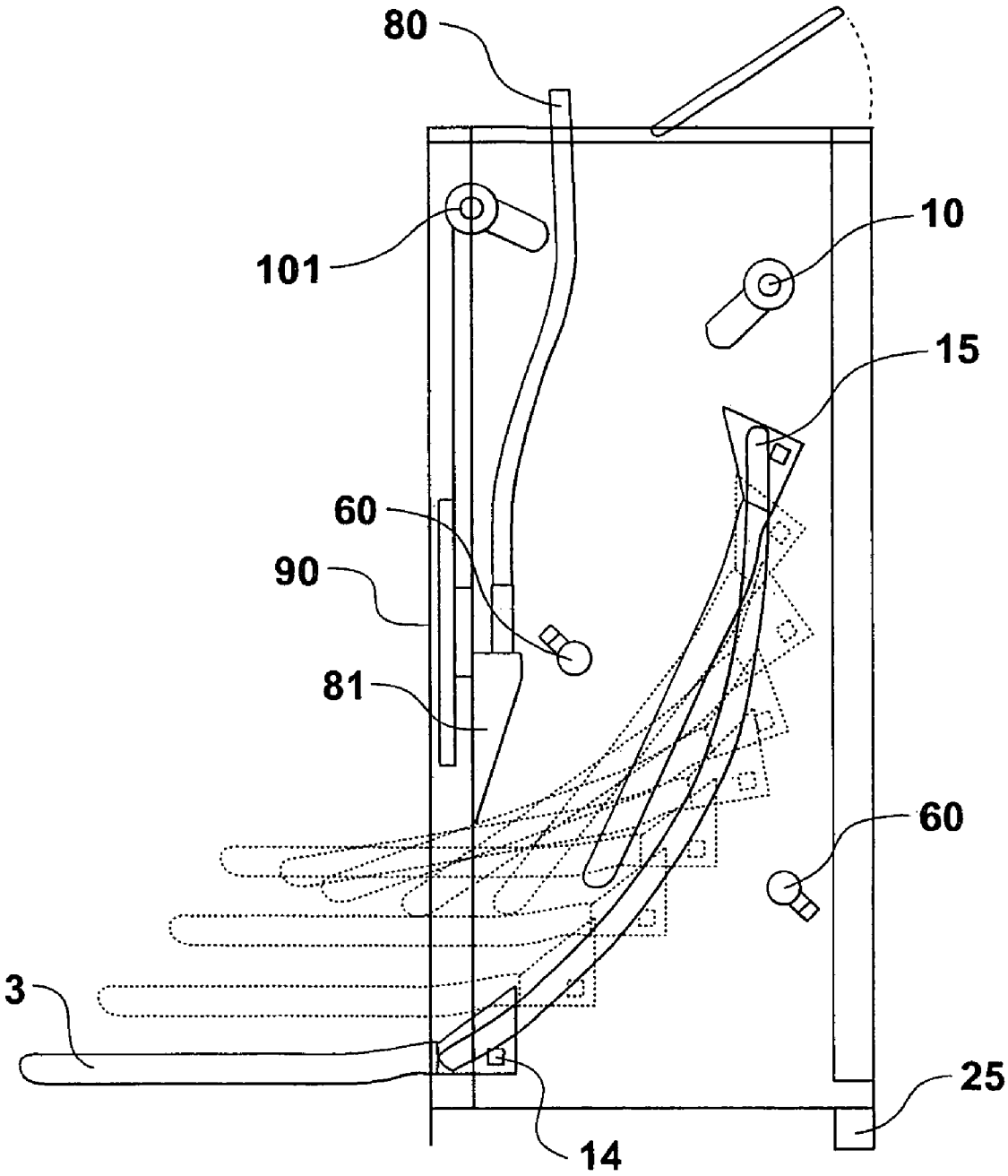
FIG. 3 is a cross sectional view of the showing the toilet seat of the preferred embodiment of FIG. 2.

FIG. 1 show a tilting mechanism or tilt type washer and FIGS. 2 & 3 show a retractable or sliding seat mechanism or retractable type seat washer. The cleaning unit includes at least one toilet seat 3. There may be several toilet seat cleaning units or several units automatically controlled. By definition when the toilet seat is down or lowered this means that the seat is ready for use by a person, and the stowed position or up position or raised position or any position not enabling use thereof, define the cleaning position. The cabinet can be adapted to be fixed within a wall cavity or against a wall or be free standing. The cleaning unit can be located within a public toilet cubicle, the unit can be rebated into the cubical wall, the unit can also be located in a service bay within a toilet cubicle.

The unit of FIG. 1 comprise a cabinet 1 adapted to receive a toilet seat 3 in a stowed position which may be an up position. A shaft 4 connects the back of the toilet seat 3 to the sides of the cabinet 1. A lever 7 is pivotally connected to the shaft 4 at pivot point 9. The unit is provided with an electric operating means having an electric output and a reverse polarity output for operation of the motors.

A first motor (or seat motor) 10 and drum 11 and a first chain 12 operates to move the seat 3 from an up position to a down position. The first chain 12 is pivotally connected to the lever 7 at pivot point 9 via a pulley 13. The pulley 13 can be located to the bottom rear corner of the cabinet so the chain goes from the drum around the pulley and then back up to the lever 7. This means that when the chain winds up around the drum 11 it pulls the lever 7 down which lifts the seat into the up/stowed position. The first, motor 10 can have a clutch 70 which can be spring loaded, operatively combined to allow the working parts to be in or out of action and to allow forced use, to not damage any parts whereby too much force will allow the part to be released.

Switching can include a seat up limit switch 16, seat down limit switch 17 and a cam 18 on the first chain 12 activates the switch to operate. Also there is a door up switch 96 and a door down switch 97. The switching which are activated when the door or seat hit them, allow further programmed sequences to be activated and can be located on the sides of the cabinet.

To power all the motors ie seat/first motor 10 and 101—door/second motor, an extra low voltage power supply should be utilized. The first motor 10 controls the moveable seat 3 from a down position to an up position when power is switched on. To protect users, an over current device is located between the motor 10 and the power supply (not shown).

This over current device activates a switch in the controller (not shown) which in turn cuts the power to the motors 10 and 101.

The same first motor 10 with a reverse polarity switch controls the movable seat 3 from an up position to a down position. The seat up switch 16 detects when the seat 3 is in a stowed or non use or up position, then a door 90 operated by a second motor 101 drops into the closed position. Once the door closed switch 97 is met, a controller such as a PC controller activates a solenoid valve 50. The solenoid valve 50 which can be located anywhere convenient controls the cleaning means by turning the water on or off as required. The cleaning means comprises at least one spray jet 60 which can be supplied from a mains water supply which can enter the unit by pipes (not shown) and when used, can exit the unit via waste 25. The cleaning means can include a fluid such as water with cleaning additives and or sterilizing means.

The spray water jets 60 are preferably located at the back of the cabinet 1 but can be placed elsewhere in the cabinet such that the seat top and or bottom can be cleaned. The water spray jets 60 can be in the form of a spray ball to cover the shape of the toilet seat 3 or a group of separate water nozzles.

As a safety measure there is included a spring loaded clutch 70 which allows for the release of the drive system 10 should the toilet seat 3 be manually moved from an up to a down position. This clutch 70 thereby prevents damage to the automatic toilet seat cleaning unit or injury, especially to a child, by allowing the mechanism to release if the seat is obstructed.

The door 90 is adapted to open to allow a toilet seat 3 to be received in an up position. The door 90 is connected to a chained drum 100 via a second chain 102 which is operable to move the door 90 up/down and to a second motor 101. The second chain 102 can be supported by a drum or roller 100 located at the top of cabinet 1. The electric operating means providing the motor 101 with an electrical output to control the door from an up to a down position and the motor having a reverse polarity output to control the door 90 from a down to an up position. The door 90 can be fabricated from any material suitable for a hygienic environment. For example this could be plastics or steel or aluminum or stainless steel. The second motor 101 controls the door 90 from a down to an up position. The same motor 101 with a reverse polarity switch controls the door from an up to a down position.

The second motor 101 has the second chain 102 connected to the door 90 such that in operation as the second chain coils around drum 100 it raises the door 90 into the open position. When the door open switch 96 is reached, the first motor 10 drives the drum 11 which is mounted on the outside of cabinet and the first chain 12 which goes around a pulley 13 located at the back bottom corner of the cabinet and is connected to the lever 7 so when the first motor 10 operates, the first chain 12 coils around the drum 11 pulling on lever 7 which rotates the axle which has the seat is attached thereto, causing the seat to tilt up into the cabinet. Once the seat 3 reaches the seat up unit switch 16, the second motor 101 is reversed to uncoil the chain from drum 100 causing the door to close.

Located above the cabinet 1 is/are an air duct(s) 80 where air from a main fan (not shown) can be forced onto the toilet seat 3 through outlet(s) 82 when the toilet seat 3 is in an up position and after the toilet seat 3 has been washed by the spray water jet(s) 60.

In order to dry the seat, we can use two small vacuum motors (not shown) which force air down through two separate tubes 80 into a plenum 81 just behind the door. The plenum 81 can be attached with brackets to the back of the door so it moves when the door moves up or down allowing it to blow air over the seat as the door rises. This plenum has a narrow slit 82 on the front side creating an air knife effect. Though other shapes besides the slit are also possible. As the door 90 rises, the fans are turned on and, as the door 90 travels up past the seat 3, the high velocity air blows the water off the seat 3. This minimises moving parts and enables the air outlet to be very close to the seat surface. Alternatively the water spray jets and air spray can be combined in single outlets with separate feeds and timed action.

Located in a wall beside the cabinet 1 is a push button switch, (not shown) which when depressed will cause the seat to be lowered from its up position to a down position, when required. The automatic cleaning of the toilet seat, and of the unit itself can be controlled with the controller which can be a programmable logic controller (PLC) or programmable circuit (PC) board.

As shown in FIGS. 2 and 3 there is a retractable toilet seat cleaning unit which provides for a lower door height or smaller door which is required under some disabled access codes that require a full length grab rail behind the toilet.

The unit includes a cabinet or housing 1 comprising a base portion having in use a front panel, a top, a bottom, sides and a back. An access means can be provided to enable access to the services or workings within the cabinet. A toilet seat 3 movably mounted within the cabinet 1. The cabinet 1 has a door 90 which is raised to be open by a chain 102 and a motor 101. Door 90 can be conveniently located in use in the front of cabinet 1. All components of the cleaning unit can at least have stainless steel portions or can be encased with or be entirely fabricated from such material. Motor 101 can be a 12 volt electric motor. The chain 102 is supported by a drum or roller 100 which allows the chain to move thereover. The seat 3 is on the carriage which travels up the pair of curved rails allowing the seat to be pulled backwards as well as upwards into its position inside the cabinet.

The unit of FIG. 2 can have the same seat washing and seat drying mechanism as previously disclosed in this description with the plenum 81 now shaped and orientated to suit the different space requirements. In the retractable unit, the plenum 81 is fixed in position and the fans operate as the seat travels past it into the down or usable position. In this example plenum 81 can be wedge shaped having the air exit (for example slit 82) at the lower end as shown in FIG. 2. In use cabinet 1 has a front door 90 and a rear door 19.

The seat 3 which can be fabricated from any suitable material has a seat fixing assembly or carriage 14 to allow it to be operatively joined to a rail assembly 15. The seat can include fibreglass material. The assembly 14 includes a carriage which is slidably attached to the rails to allow the seat to be raised within the cabinet 1 for washing and drying. The seat 3 is pulled up the rails 15 by any flexible means such as cable(s) or chain(s) 12 which chain is/are supported by a further drum or roller 11 and a motor 10. As shown in FIGS. 2 and 3 the seat and carriage are connected such that movement up a curved or angular or straight track is possible. Instead of the lever 7 this model uses a moving carriage 14 to move the seat therefore this unit requires a deeper and larger cabinet 1 than the previous model but has the advantage of requiring a smaller door 90 or lower door opening to the public area while allowing for the placement of a handrail to assist disabled people.

In operation for the retractable unit, the second/door motor 101 drives the shaft or drum 100 which is supported on each side of the cabinet. The second chain 102 is attached to the door 90, so that as the drum 100 revolves the second chain 102 is wound up around the drum 100 lifting up the door. Once the door meets a door up switch 96, the first motor 10 is activated, the first motor 10 being connected to another shaft or seat drum 11 which is supported on each side of the cabinet so that the first chain 12 which is attached to the seat carriage 14, and as the drum 11 revolves, the first chain 12 is wound up around the drum 11 pulling the seat and carriage 14 up the rails 15.

In summary the operation of both units can include some or all of the following steps:

toilet cubicle door closes;
user pushes start button or seat request activating means;
cleaning unit door opens and seat moves to a seat down position;
unit door closes;
user makes use of toilet;
user activates basin sensor or leaves toilet;
unit door 90 opens;
seat rises and unit door 90 gravity closes;
seat is washed and then dried;
door is ready to open to allow seat to automatically move by gravity to the down position to be ready for use.

Initially the door is closed with a cleaned seat being in a stowed or non use position.

Normal Operation of the Tilt Type Washer—FIG. 1

Seat request button (not shown) is pushed, drum motor 101 turns drum 100 rolling the second chain 102 up on the drum 100 bringing door 90 up to an open position whereby the door up switch 96 is hit to allow the seat to drop.

While door lifts, two vacuum fans blow air down tubes 80 to plenum 81 which is attached to the back of the door but mounted on a stand off bracket (not shown) so the air goes through the slot on the front face of the plenum 81 and dries the top face of the seat as the door lifts up.

Seat motor 10 drives small drum at 11 releasing chain 12 going round pulley 13 at bottom corner of cabinet unmarked then up to lever 7 allowing gravity to pull seat down into lowered or usable position whereby the seat down switch 17 is hit to activate door motor 101.

Door motor 101 rotates drum in reverse allowing door to drop into closed position to hit the door down switch 97.

After use, when the person uses the wash basin or presses the door open button, a signal will pass to the PLC which will activate door up motor 101 to raise the door to hit door open switch 96.

Seat motor 10 will activate in the reverse direction to raise the seat up into the stowed or up or vertical position, to hit the seat up switch 16.

Door motor 101 will operate in reverse direction to allow the door to drop into the closed position hitting the door closed or down position 97.

Water spray nozzles 80 at the back of the cabinet will spray the toilet seat with mains pressure water.

Seat will remain in cabinet for future request.

Retractable Seat Wash Unit—FIGS. 2 & 3

Seat request button is pushed, door motor 101 turns drum 100 rolling chain 102 up on the drum bringing door 90 up to open position to hit the door up switch 96.

Seat motor 10 drives drum 11 releasing chain 12 allowing gravity to pull seat carriage 14 down into lowered position to hit the seat down switch 17.

While seat 3 travels down and out, the vacuum motors blow air through tubes 80 to plenum 81 which is in a fixed position just above the opening. The slot at the bottom of the plenum allows air to blow over the top face of the seat, drying it as the seat moves into the extended or lowered position.

Door motor 101 rotates drum in reverse allowing door to drop into closed position to hit the door down switch 97.

After use, when the person uses the wash basin or presses the door open button, a signal will pass to the PLC which will activate door up motor 101 to raise the door to hit the door up switch 96.

Seat motor and drum 10 will activate in the reverse direction to raise the seat up into the retracted position to hit the seat up switch 16.

Door motor 101 will operate in reverse direction to allow the door to drop into the closed position to hit the door down switch 97.

Water spray balls 60 above and blow seat surface will spray the toilet seat with mains pressure water.

Seat will remain in cabinet for future request.

In use a person entering the unisex toilet of the present invention, will find the toilet seat in an up position and the cabinet door 90 in a closed position. Optionally the door of the unisex toilet will close automatically after the person has entered the unit.

Should the seat be required to be lowered this can be accomplished by depressing a seat request activating means or a seat button located on the wall near the cabinet. After the person has used the toilet, the automatic washing of the toilet seat is commenced either by the person washing their hands, which will activate the motor to open the cabinet door and raise the toilet seat before the seat is washed; or when the person exits the unisex toilet the doors on closing will activate the motor which opens the cabinet door and raise the toilet seat before the seat is washed.

While aspects of the present invention have been described by way of example only it will be appreciated that modifications and additions may be made thereto without departing from the scope from the present invention.

Throughout the description of this specification the word "comprise" and variations of that word, such as "comprising", are not intended to exclude other additives, components, integers or steps.

SCHEDULE OF COMPONENTS

A. Tilt Type Washer Unit
1 Cabinet
3 Seat
4 Shaft
7 Lever
9 Pivot point
10 First/door motor
11 Drum
12 First/seat chain
13 Pulley
16 Seat up switch
17 Seat down switch
18 Cam
25 Waste outlet
50 Solenoid valve
60 Water spray
70 Clutch
80 Air ducts
81 Plenum
82 Plenum outlet
90 Door

96 Door up switch
97 Door down switch
100 Door drum
102 Second/door chain B. Retractable Washer Unit
1 Cabinet
3 Seat
10 First/seat motor
14 Seat drum
15 First/seat chain
14 Carriage
15 Rails
16 Seat up switch
17 Seat down switch
19 Rear door
25 Waste outlet
50 Water spray solenoid
60 Water spray nozzle
80 Air duct
81 Plenum
82 Plenum outlet
90 Door
96 Door up switch
97 Door down switch
100 Door drum
101 Second/door motor
102 Second/door chain

ADVANTAGES OF THE INVENTION

The toilet seat cleaning units have the following advantages:
Safe to use.
Vandal resistant.
Simple operation.
Straight forward running
Easy installation.
Automatic operation.
Modest running costs.
Few running parts.
Easily connectable to power.
Small door opening.
Convenient construction to allow disabled, infirm, children to use.

What is claimed is:

1. An automatic toilet seat cleaning unit comprising:
a cabinet adapted to receive a toilet seat in a stowed position;
an electric operating means operatively connected to the toilet seat to move said toilet seat to said stowed position, said toilet seat being lowered from said stowed position to a use position by gravity;
a cleaning means, to clean the toilet seat when the seat is or has been stowed by the electric operating means; and
at least one cabinet door adapted to open to allow the toilet seat to be received in the stowed position, said at least one cabinet door being closed by gravity.

2. An automatic toilet seat cleaning unit as claimed in claim 1, wherein the unit includes a control unit to control the cleaning and or seat movement.

3. An automatic toilet seat cleaning unit as claimed in claim 2, wherein the control unit is a PLC or PC board.

4. An automatic toilet seat cleaning unit as claimed in claim 3, wherein the cabinet can be rebated into a wall of a public toilet.

5. An automatic toilet seat cleaning unit as claimed in claim 4, wherein the cabinet can be rebated into a wall of a public toilet wherein the public toilet has a service bay having the cabinet located therein.

6. An automatic toilet seat cleaning unit as claimed in claim 5 wherein the cleaning means comprises at least one spray means located inside the cabinet.

7. An automatic toilet seat cleaning unit as claimed in claim 6 wherein the cleaning means can be located near the top face of the toilet seat with a second cleaning means being located near the bottom face of the seat.

8. An automatic toilet seat cleaning unit as claimed in claim 7 wherein the cleaning means is a fluid.

9. An automatic toilet seat cleaning unit as claimed in claim 8 wherein the electric operating means utilises extra low voltage to operate.

10. An automatic toilet seat cleaning unit as claimed in claim 9 wherein the unit comprises a shaft connecting the back of the toilet seat to the sides of the cabinet, a lever pivotally connected to a first chain and a first motor connected to said lever and operable to move the seat up/down, a switch to detect when the seat is in an up position, the electric operating means providing a power supply to the first motor, the first motor providing an electrical output to control the moveable seat from a down to an up position, the first motor also providing a reverse polarity output to control the seat from an up to a down position and a solenoid valve to control at least one water spray jet.

11. An automatic toilet seat cleaning unit as claimed in claim 10 wherein the unit includes a spring loaded clutch to allow the toilet seat to be moved manually.

12. An automatic toilet seat cleaning unit as claimed in claim 10 wherein a second chain is connected to said door, a drum connected to a second motor and operable to move the door up/down, the electrical operating means providing an electrical output to the second motor, a switch to detect when the door is in an open position, the second motor having an electrical output to control the door from an up to a down position, and the motor having a reverse polarity output to control the door from a down to an up position.

13. An automatic toilet seat cleaning unit as claimed in claim 12 wherein the second motor has the second chain connected to the door wherein in operation the second chain coils around drum it raises the door into the open position, when the door open switch is reached the first motor drives the drum which is mounted on the outside of cabinet, the first chain which goes around a pulley located at the back bottom corner of the cabinet and is connected to the lever so when the first motor operates the chain coils around the drum pulling on lever which rotates the axle which the seat is attached to causing the seat to tilt up into the cabinet, once the seat reaches the up unit switch, the second motor is reversed to uncoil the chain from drum causing the door to close.

14. An automatic toilet seat cleaning unit as claimed in claim 13 wherein the second motor drives the drum which is supported on each side of the cabinet wherein the second chain being attached to the door, as the drum revolves the second chain is wound up around the drum lifting up the door, once the door meets a door up switch, the first motor is activated, the first motor being connected to another shaft or drum which is supported on each side of the cabinet wherein the first chain being attached to the seat carriage, as the drum revolves, the first chain is wound up around the said another drum pulling the seat and carriage up the rails.

15. An automatic toilet seat cleaning unit as claimed in claim 13 wherein the unit includes a dryer apparatus which includes a fan which directs air into the cabinet to dry the seat.

16. An automatic toilet seat cleaning unit as claimed in claim 15 wherein the dryer apparatus includes a plenum having an air exit means shaped to create an air knife effect when being used to dry the seat.

17. An automatic toilet seat cleaning unit as claimed in claim 16 wherein the unit includes a seat request button to activate a motor to raise the door while drying the seat before it is lowered ready for use.

18. An automatic toilet seat cleaning unit as claimed in claim 9 wherein the unit comprises a carriage connecting the back of the toilet seat to rails connecting to the sides of the cabinet, the carriage slidably connecting to the rails, the electric operating means providing an electrical output to a first motor, a first chain and first motor connected to said carriage and operable to move the seat up/down, a switch to detect when the seat is in an up position, the first motor providing an electrical output controlling the moveable seat from a down to an up position, and the first motor also providing a reverse polarity output to control the seat from an up to a down position, a solenoid valve to control at least one water spray jet, the seat is operatively connected to the carriage which travels up the pair of rails allowing the seat to be pulled backwards as well as upwards into its position inside the cabinet.

19. A method of operating an automatic toilet seat cleaning unit wherein the unit comprises a cabinet adapted to receive a toilet seat in an up position, a cleaning means to clean a toilet seat when the seat is within said cabinet, at least one door located on the cabinet and a seat request activation means, the door being adapted to open to allow the toilet seat to be received into the up position, the unit door being closed or lowered with the seat raised within the cabinet; the method including:

pressing seat request activation means, to use the seat;
door opens or is raised;
seat dropping to a lowered or ready to be used position by gravity lowering the seat;
closing or lowering the door by gravity lowering the door;
after use, raising the door;
moving the seat to be within the cabinet;
closing the door by gravity;
cleaning means cleans seat.

20. The method of claim 19 wherein while lifting the door, a drying apparatus dries the seat before being lowered ready for use.

21. The method of claim 20 wherein the cleaning means includes washing the seat.

22. The method of claim 21 wherein after use of the seat, pressing a toilet door opening button to operatively driving the unit door to be raised and open ready to receive the seat.

* * * * *